US009622528B1

(12) United States Patent
Pitts et al.

(10) Patent No.: US 9,622,528 B1
(45) Date of Patent: Apr. 18, 2017

(54) BALL CAP WITH SLOTTED BILL FOR EYEGLASS RETENTION

(71) Applicants: Steven G. Pitts, Coffeyville, KS (US); Cary D. Pitts, Owasso, KS (US)

(72) Inventors: Steven G. Pitts, Coffeyville, KS (US); Cary D. Pitts, Owasso, KS (US)

( * ) Notice: Subject to any disclaimer, the term of this patent is extended or adjusted under 35 U.S.C. 154(b) by 0 days.

(21) Appl. No.: 14/581,394

(22) Filed: Dec. 23, 2014

Related U.S. Application Data

(60) Provisional application No. 61/920,950, filed on Dec. 26, 2013.

(51) Int. Cl.
*A42B 1/00* (2006.01)
*A42B 1/24* (2006.01)
*A42B 1/18* (2006.01)

(52) U.S. Cl.
CPC ..... *A42B 1/247* (2013.01); *A42B 1/18* (2013.01); *A42B 1/248* (2013.01)

(58) Field of Classification Search
CPC ..... A42B 1/24; A42B 1/004; A42B 1/062; A42B 1/247; A42B 1/18; A42B 1/242; A42B 1/063
USPC ..... 2/195.1, 195.5, 195.6, 175.1, 209.13, 2/209.14
See application file for complete search history.

(56) References Cited

U.S. PATENT DOCUMENTS 1,696,198 A * 12/1928 Gross ..... A42B 1/247 2/10
4,292,689 A * 10/1981 Townsend, Jr. ..... A61F 9/045 2/12
D263,515 S * 3/1982 Townsend ..... D2/893
5,742,944 A * 4/1998 Pfefferman ..... A42B 1/062 150/106
5,920,913 A * 7/1999 Brandon ..... A42B 1/006 2/19
5,987,648 A * 11/1999 Boyd ..... A42B 1/241 2/171.6
6,185,748 B1 2/2001 DeChambeau
6,244,706 B1 6/2001 Maher
6,457,183 B1 * 10/2002 Perry, Sr. ..... A42B 1/062 2/195.1
6,644,807 B1 11/2003 Hood
6,647,554 B1 11/2003 Yan
7,398,560 B1 * 7/2008 Swensen ..... A42C 5/04 2/182.2
7,484,845 B2 2/2009 Douglas
(Continued)

FOREIGN PATENT DOCUMENTS

WO WO0191679 12/2001
WO WO2012046150 A1 4/2012

OTHER PUBLICATIONS http://sunsnares.com—website for purchase of eyeglass retainers; Oct. 13, 2013.

*Primary Examiner* — Tejash Patel
(74) *Attorney, Agent, or Firm* — Hovey Williams LLP

(57) ABSTRACT

An improved ball cap (10, 40, 102) is provided having a head-receiving dome (13, 42) and a forwardly extending bill (20, 44, 104). The bill (20, 44, 104) is equipped with at least one eyeglass-retaining slot (36, 50, 52) sized and configured to receive the lower margins of lenses (30) forming a part of eyeglasses (28); the slot (36, 50, 52) may be designed to prevent substantial through-passage of the lenses (30) through the slot (36, 50,52). The slots (36, 50, 52) may be equipped with retainer structure (38, 46).

13 Claims, 5 Drawing Sheets

(56) References Cited

U.S. PATENT DOCUMENTS

| | | | | |
|---|---|---|---|---|
| 7,703,153 | B2 | 4/2010 | de Taboada | |
| D617,981 | S * | 6/2010 | Hines | D2/893 |
| 7,866,813 | B2 | 1/2011 | Anhalt | |
| 7,904,470 | B2 * | 3/2011 | Kuerschner | G06Q 10/08 707/770 |
| 7,904,970 | B2 | 3/2011 | Thomas | |
| 7,979,920 | B2 | 7/2011 | Gilman | |
| 8,381,359 | B1 | 2/2013 | McArdle | |
| D718,021 | S * | 11/2014 | Werczberger | D2/882 |
| 2004/0210982 | A1 * | 10/2004 | Kronenbeger | A42B 1/24 2/171 |
| 2006/0152671 | A1 | 7/2006 | Risso et al. | |
| 2011/9912343 | | 1/2011 | Gutierrez-Lemini et al. | |
| 2011/0078843 | A1 | 4/2011 | Kennedy | |
| 2015/0164167 | A1 * | 6/2015 | Gayer | A42B 1/062 2/195.1 |

* cited by examiner

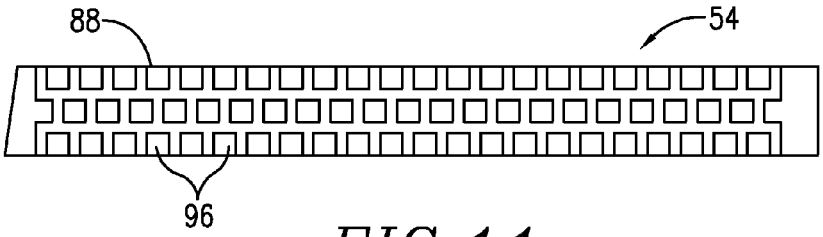
FIG. 11.
FIG. 12.
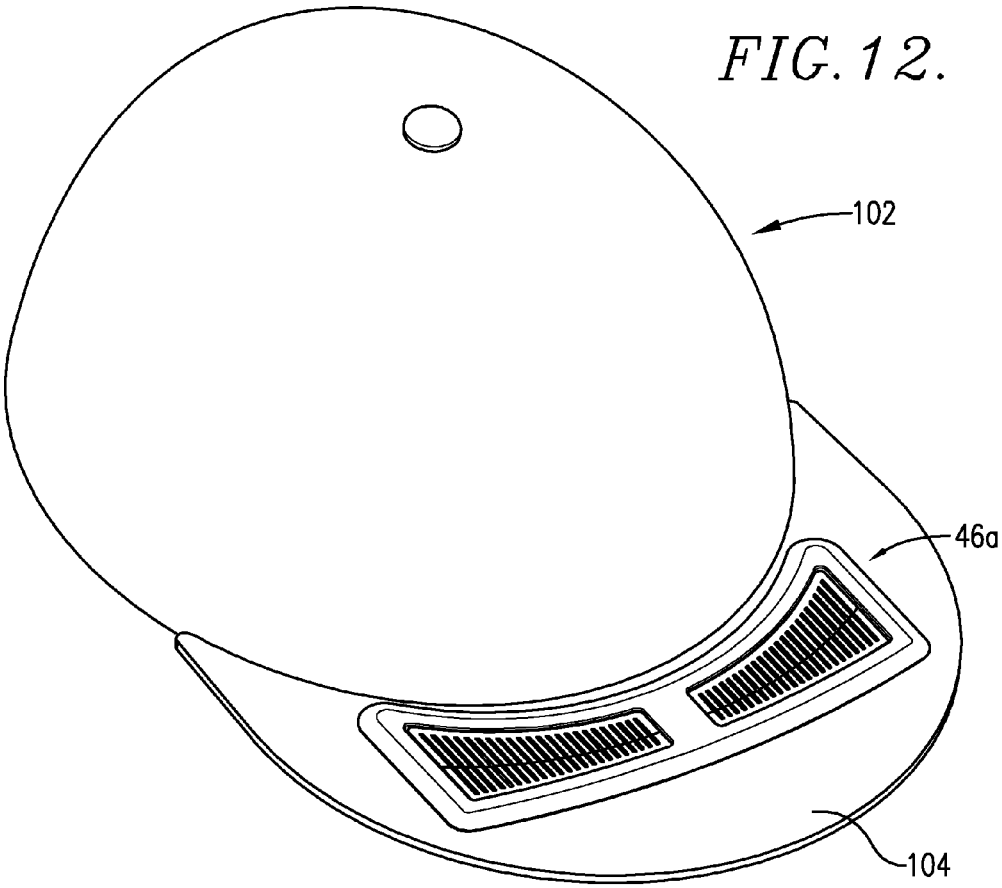

BALL CAP WITH SLOTTED BILL FOR EYEGLASS RETENTION

CROSS-REFERENCE TO RELATED APPLICATION

This application claims the benefit of identically-titled provisional application, Ser. No. 61/920,950, filed Dec. 26, 2013, which is incorporated hereby by reference in its entirety.

BACKGROUND OF THE INVENTION

Field of the Invention

The present invention is broadly concerned with improved ball cap designs wherein the bills thereof include eyeglass-retaining slots permitting the wearer to temporarily store eyeglasses on the cap bill without fear of loss or breakage of the eyeglasses. More particularly, the invention is concerned with modified caps wherein the bills are slotted, with or without additional eyeglass-retainer structure, in such a way as to detachably retain the eyeglasses against inadvertent dislodgement.

Description of the Prior Art

Ball cap wearers often also wear eyeglasses, either vision-correcting eyeglasses or sunglasses. It is quite common for cap wearers, when they are not using the eyeglasses, to place the eyeglasses with the lower margins of the lenses thereof on top of the cap bill, with the eyeglass temples extending rearwardly along the sides of the cap. As long as the wearer does not significantly move his or her head or bend over, this arrangement is satisfactory. However, when such a cap wearer significantly moves his or her head, the supported eyeglasses can easily fall off of the cap, leading to loss or breakage of the eyeglasses. Therefore, it would be desirable to be provide some means of temporarily retaining eyeglasses on ball caps.

A number of efforts along these lines have been made in the past. In many cases, means have been provided for retaining the eyeglass temples against the sides of the ball caps, in the form of elastic retainers or the like. For example, U.S. Pat. Nos. 7,866,813 and 8,381,359 describe variations on this concept. Other references include U.S. Pat. Nos. 6,185,748, 6,244,706, 6,644,807, 6,647,554, 7,485,845, and 7,979,920, U.S. Patent Publications Nos. 2006/0152671, 2011/0012343, and 2011/0078843, and PCT Publication Nos. WO 2011091679 and WO 2012/046150.

U.S. Pat. No. 7,703,153 describes a combination hat and eyeglass arrangement, wherein a cap bill is provided with a large continuous slot adjacent the dome of the cap. This slot is sized and configured to allow the wearer to selectively move the pivotally attached eyeglasses between an upper storage position and a lower use position where the lenses cover the wearer's eyes. This apparatus prevents fine adjustment of the eyeglasses, as is often needed to properly wear eyeglasses. Moreover, the pivotal attachment of the eyeglasses to the cap requires rather complicated steps to detach the eyeglasses for normal use.

U.S. Pat. No. 7,904,970 is also directed to a cap with eyeglass-holding structure, in the form of side-mounted temple retainers and a forward, bill-mounted flair, which extends upwardly from the upper surface of the bill. As such, the flair detracts from the appearance of the cap and can impede viewing of a logo or the like on the crown of the cap. Moreover, the use of specialized temple mounts further detracts from the appearance of the cap.

There is therefore a need in the art for an improved cap design which preserves the well-known and accepted appearance of a ball cap, while at the same time affording a means of readily and safely retaining eyeglasses on the cap bill, so that the eyeglasses may be temporarily stored on the bill and readily donned as desired by the wearer.

SUMMARY OF THE INVENTION

The present invention overcomes the problems described above, and provides an improved ball cap having conventional head-receiving dome section and a protruding bill (which may be curved or flat). The bill has at least one elongated eyeglass-retaining slot formed therein and positioned forwardly of the dome section. The slot is operable to receive and hold the lower margin of a pair of eyeglasses, so as to permit the eyeglass temples to extend rearwardly from the bill and along the sides of the dome section. The slot may be sized and configured to prevent any substantial passage of the eyeglass lenses through the slot, to thus retain the eyeglasses when not in use while allowing easy manual removal from the slot.

The eyeglass-retaining bill slot may be a unitary slot or, more preferably, a pair of substantially aligned slots formed in the bill, each slot sized and configured to receive one of the lenses of the eyeglasses. Whether one or a pair of slots is employed, the slot(s) may be provided with supplemental eyeglass-retainer structure, e.g., the slot(s) may be lined with a soft fabric which assists in retention of the eyeglasses and assures that the eyeglasses are not damaged or scratched during storage. Additionally, the slot(s) may be complete through-slot(s) extending through the thickness of the bill, or in the form of blind slot(s) or recesses which extend only partially through the bill thickness.

In one preferred embodiment, the eyeglass-retaining slot(s) are provided with retainer structure in the form of generally opposed, inwardly extending projections for receiving the eyeglasses. Advantageously, the projections are elongate and formed of resilient material, such as synthetic rubber. In one particular embodiment, the projections are in the form of opposed sets of resilient fingers, which cooperatively and frictionally grip eyeglasses to securely retain them in place on the cap bill. The fingers may be substantially aligned or offset relative to each other, and may be arranged in one or more rows.

In another aspect of the invention, eyeglass-retainer structure designed to be secured to a ball cap bill is provided, where the bill has at least one opening therein. This retainer structure comprises a frame for mounting on the bill and presenting a through opening in general alignment with the bill opening. A plurality of inwardly extending, resilient projections are mounted on the frame with a passageway between the inner ends of the projections, and the latter are operable to engage the lower margin of the eyeglasses for retention purposes. The projections may be in the form of opposed, cantilever fingers, and the fingers may be in point contact or slightly spaced apart.

BRIEF DESCRIPTION OF THE DRAWINGS

FIG. 11 is an enlarged elevational view of the inboard face of one of the resilient projection members depicted in FIG. 10; and FIG. 12 is a perspective view similar to that of FIG. 6, but illustrating the retainer structure thereof on a flat cap bill.

DETAILED DESCRIPTION OF THE PREFERRED EMBODIMENTS

Embodiment of FIGS. 1-5

Figure 1:
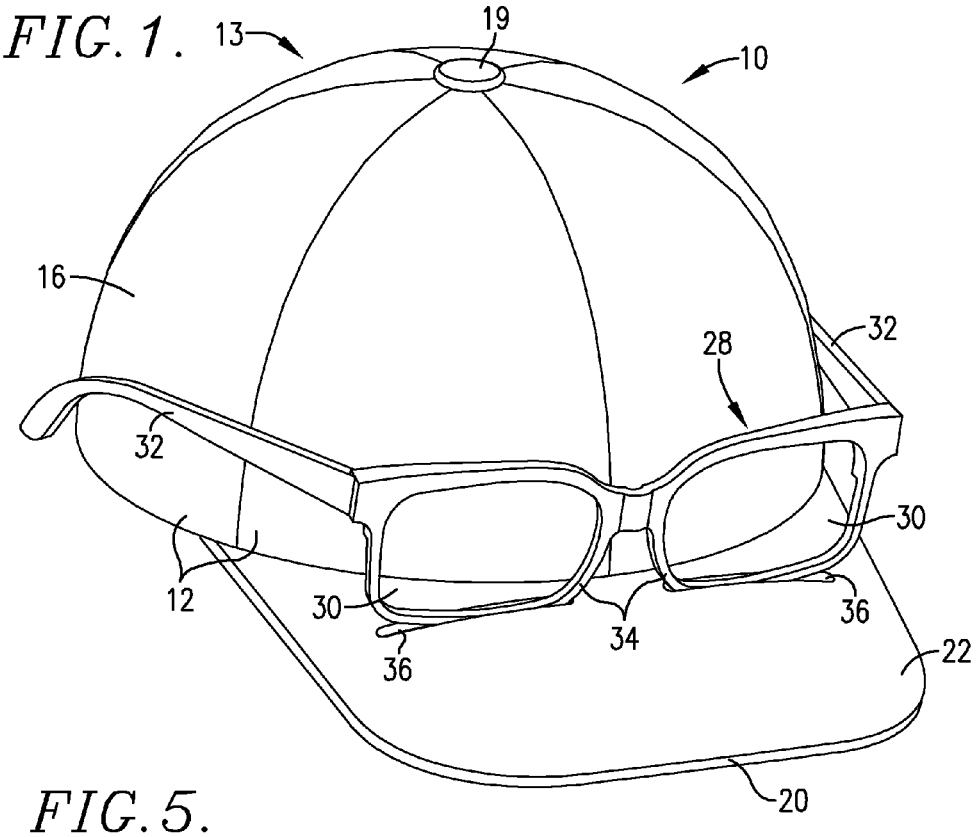
FIG. 1 is a top perspective view of a ball cap in accordance with the invention, with a curved, forwardly-projecting bill, and illustrated with a pair of eyeglasses situated within the retention slots of the cap bill.
Figure 5:
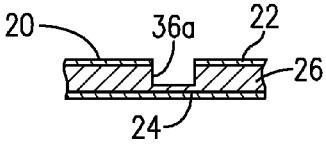
FIG. 5 is a fragmentary, vertical sectional view of another embodiment of the invention, wherein the eyeglass-retaining slots are in the form of recesses.
Figure 2:
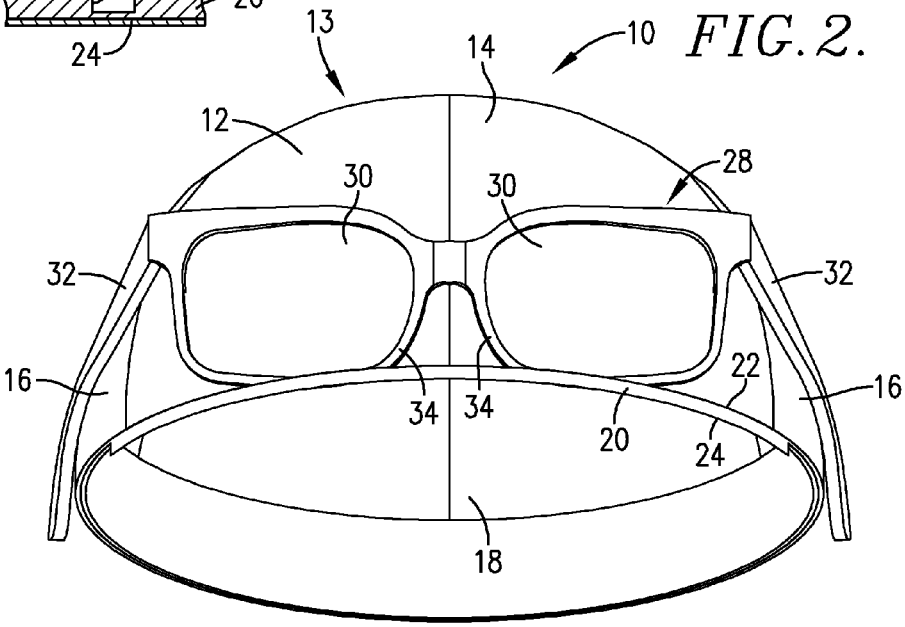
FIG. 2 is an elevational view of the ball cap and eyeglasses illustrated in FIG. 1.
Figure 3:
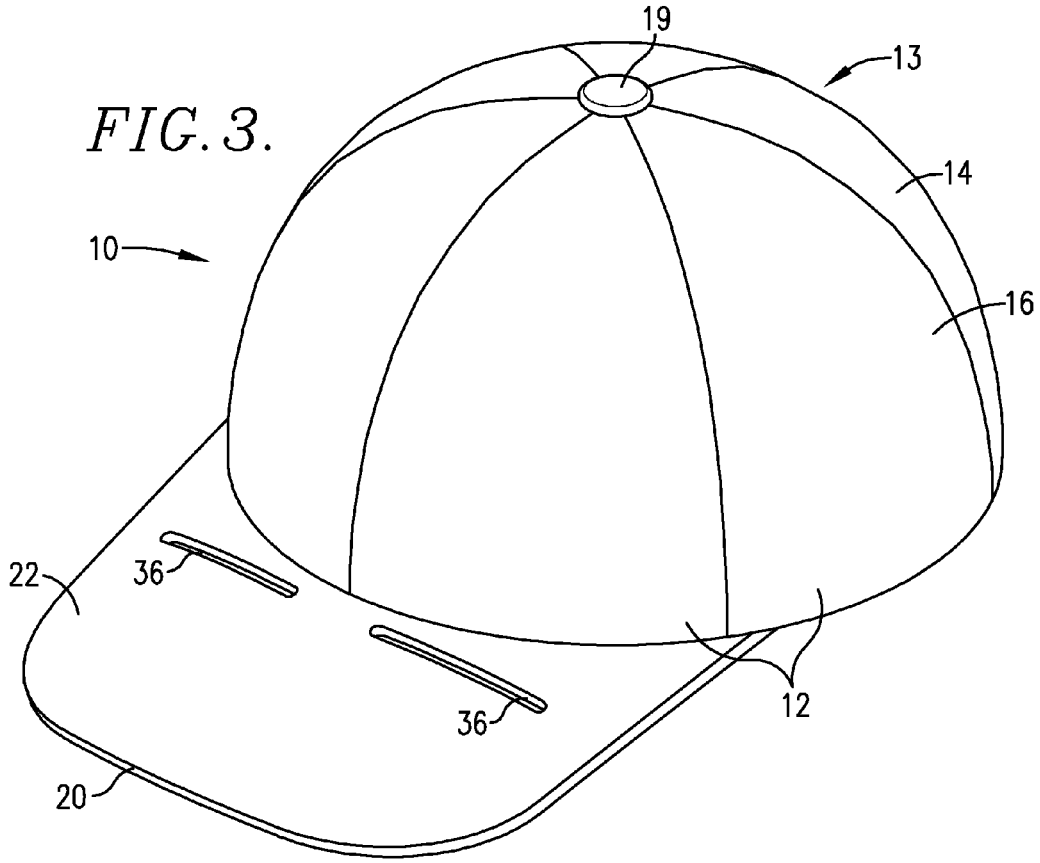
FIG. 3 is a top perspective view of the ball cap of FIG. 1, shown without a pair of eyeglasses mounted thereon.

Turning now to the drawings, a ball cap 10 is illustrated in FIGS. 1-4 and has the usual cap components, including a plurality of interconnected cap panels 12 defining a generally dome-shaped head-receiving portion 13 including a crown 14, side panels 16, and a rear section 18. The cap also has an uppermost decorative central button 19, as shown. The cap is provided with a forwardly projecting, curved bill 20 composed of upper and lower fabric pieces 22 and 24 with a piece of cardboard or plastic 26 sandwiched between the fabric pieces 22, 24. The bill may be formed by stitching or by adhesively securing the pieces 22, 24 to the piece 26.

The bill 20 is specially configured so as to retain a pair of conventional eyeglasses 28 thereon having a pair of lenses 30 and rearwardly projecting temples 32. The lenses 30 may be surrounded by framing 34 as illustrated, or the lenses may be supported only by an upper segment of the frame. To this end, the bill 20 is provided with a pair of identical, elongated, substantially parallel and aligned eyeglass-retaining slots 36, which extend through the entire thickness of bill 20. Importantly, however, the slots 36 are configured so as to prevent full passage of the lenses 30 through the slots. Thus, the invention is distinctly different from the previously described U.S. Pat. No. 7,703,153, which provides a comparatively large slot permitting the eyeglass lenses to fully shift between an upper storage position and a lower use position in front of the wearer's eyes. In the present invention, it is contemplated that in preferred forms no substantial part of the lenses extends below the bill 20, but in any case no more than about 20% (and more preferably no more than about 10%) of the vertical height of the lenses should protrude below the undersurface of the bill.

When the cap wearer does not wish to use the eyeglasses (which for example may be normal vision-correcting eyeglasses or sunglasses), the lower edges of the lenses, whether framed or not, are positioned within the slots 36 with the temples 32 extending rearwardly along the panels 16 of the cap 10. In this orientation, the wearer is free to move his or her head or to bend over without fear that the eyeglasses 28 will fall from the cap 10 or otherwise be dislodged. At the same time, it is a simple matter for the wearer to manually lift the eyeglasses 28 from the slots 36 and don the eyeglasses in the normal manner.

Figure 4:
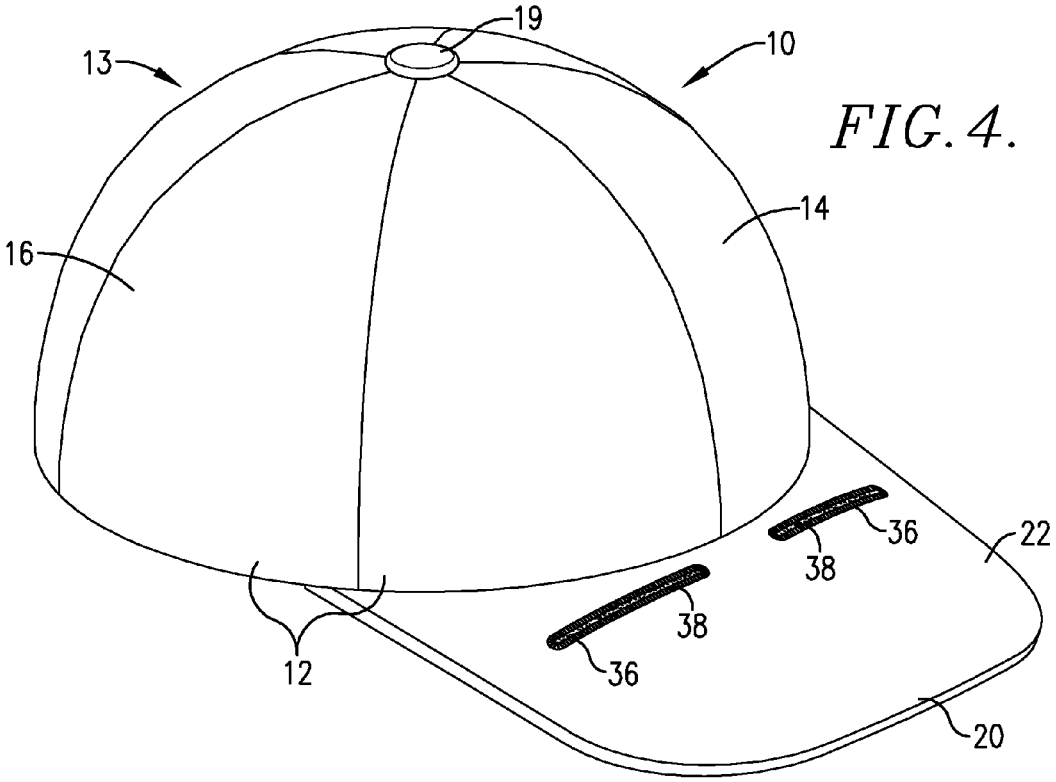
FIG. 4 is a perspective view similar to that of FIG. 3, but illustrating a soft cloth lining in the eyeglass-retaining slots.
Figure 6:
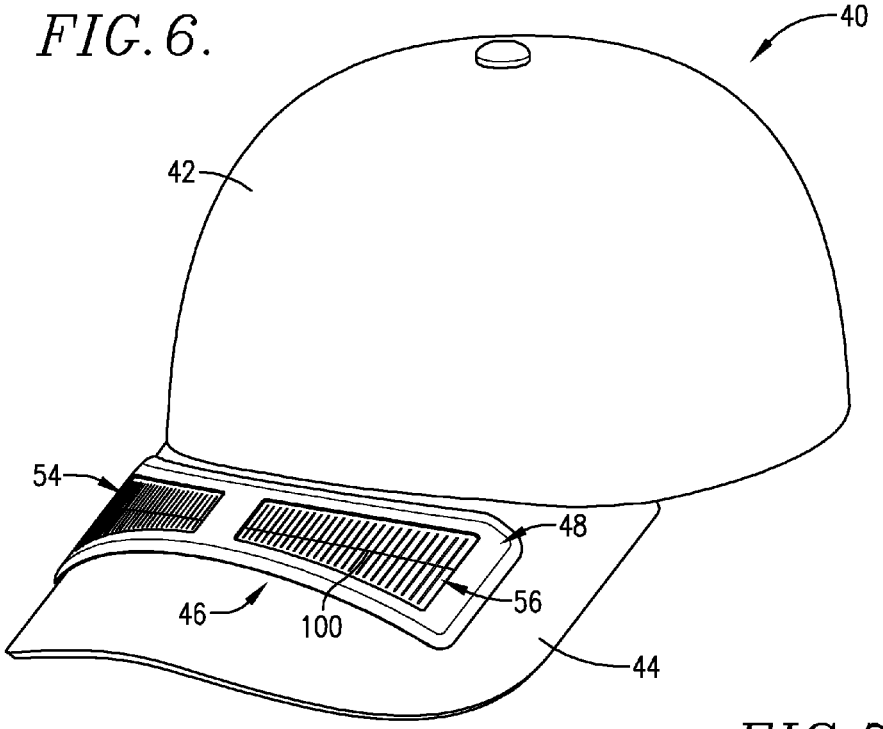
FIG. 6 is a perspective view of another embodiment of the invention, where the curved cap bill has opposed, resilient, eyeglass-retaining projections forming a part of the eyeglass-retainer structure.
Figure 7:
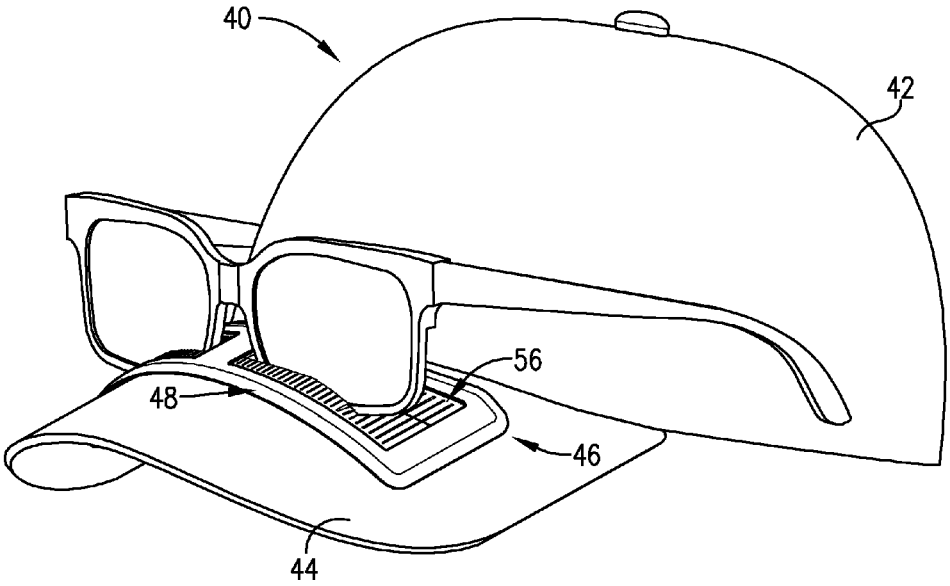
FIG. 7 is another perspective view similar to that of FIG. 6, but illustrating the placement of a pair of eyeglasses within the retainer structure.
Figure 8:
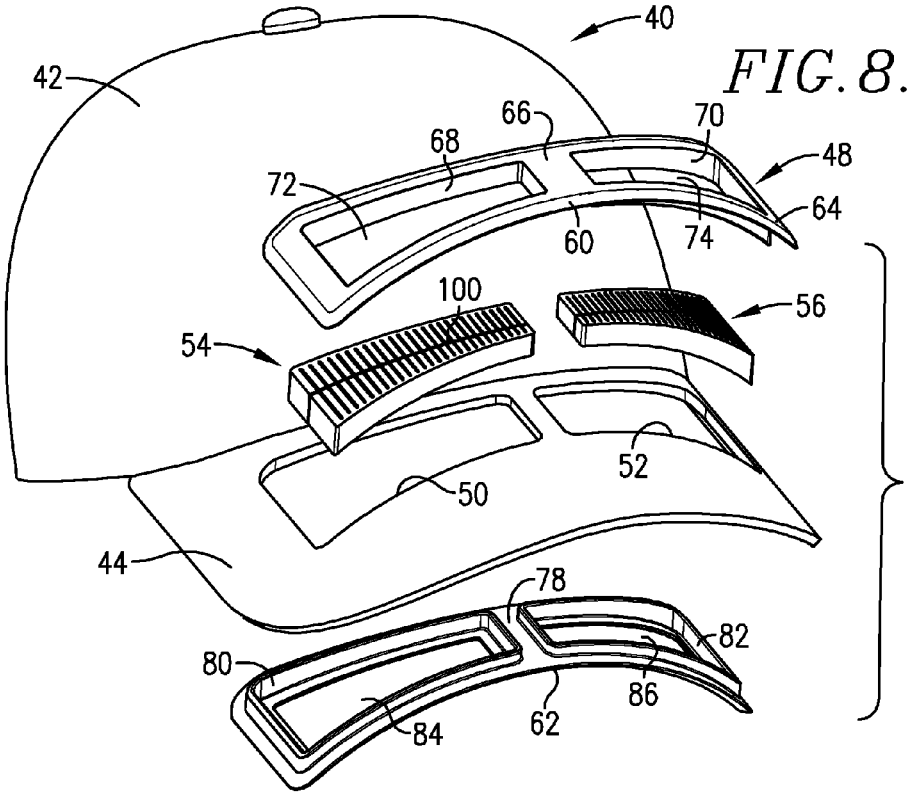
FIG. 8 is an exploded perspective view of the cap illustrated in FIGS. 6-7, depicting the parts of the eyeglass-retainer structure.
Figure 9:
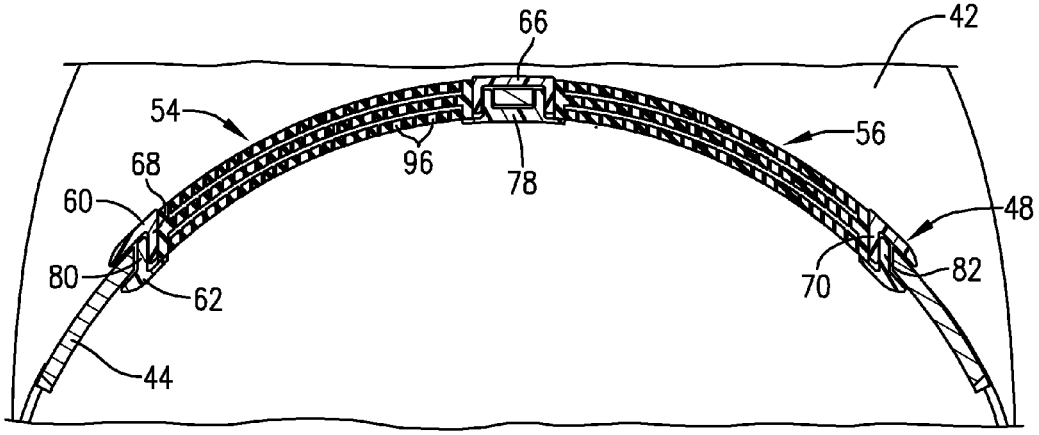
FIG. 9 is an enlarged, vertical sectional view of the cap bill of FIG. 6 with the retainer structure attached thereto.

While the through-slots of FIGS. 1-4 are completely adequate for the purposes of the invention, a number of variations may be employed. For example, as illustrated in FIG. 4, the slots 36 may be lined along their inner surfaces by soft velvet or plush material 38. In such instances, the slots 36 may be slightly wider than those of FIGS. 1-3, in order to accommodate the lining material. The use of such material assures that the eyeglasses 28 are not damaged or that the lenses 30 thereof do not become scratched during use of the cap 10.

In other embodiments, the slots may be in the form of simple recesses 36*a* (FIG. 5), in lieu of the complete through-slots. Likewise, while a pair of slots 36 have been depicted, it will be understood that a single unitary slot, either a through-slot or a recess, can be used instead of the illustrated slot pair.

Embodiment of FIGS. 6-11

Turning now to FIGS. 6-11, it will be seen that another conventional ball cap 40, having dome section 42 and forwardly projecting curved bill 44, is equipped with modified eyeglass retainer structure 46 secured to bill 44. Broadly, the retainer structure 46 includes a peripheral frame 48 secured to and within a pair of generally aligned, somewhat trapezoidal openings 50 and 52 formed within bill 44 (FIG. 8), and resilient eyeglass-retainer members 54 and 56 mounted within the frame 48. The members 54 and 56 are designed to resiliently and frictionally grip the lower margins of eyeglasses 58 in order to prevent inadvertent dislodgement thereof.

In more detail, it will be observed that the frame 48 includes upper and lower frame parts 60 and 62. The upper frame part 60 includes a surrounding top wall 64 with a central interconnect 66, as well as depending sidewalls 68 and 70, which cooperatively define through openings 72 and 74. The lower frame part 62 has a surrounding bottom wall 76 with a central web 78 and inboard, upstanding sidewalls 80 and 82; the bottom wall 76 has through openings 84 and 86 inward of the corresponding sidewalls 80 and 82.

Figure 10:
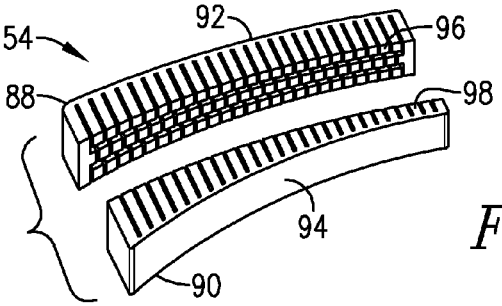
FIG. 10 is an exploded perspective view of the cooperating resilient projection members forming a part of the retainer structure illustrated in FIGS. 6-9.

The resilient members 54 and 56 are supported by the sidewalls 68 and 70 of upper frame part 60 and substantially fill the through openings 72 and 74. The retainer members 54, 56 are handed in order to conform to the bill curvature, i.e., the member 54 is designed to fit within opening 72, and member 56 is designed to fit within opening 74. Referring to FIGS. 10-11, the member 54 has a pair of structurally distinct, opposed bodies 88 and 90, each having an outer wall 92, 94, with a series of inwardly extending projections or fingers 96, 98. In this embodiment, the fingers 96, 98 are in direct opposition to each other, and a passageway 100 is provided at the inboard ends of the fingers. Moreover, three vertically stacked rows of fingers are provided with each member. As illustrated, the passageway 100 is curved to accommodate many types of popular eyeglasses, which typically do not include a lower frame. However, the passageway 100 may be of any orientation and shape desired to accommodate various types of eyeglasses. The member 56 has the same structure as member 54, save for the described handedness.

The retainer structure 46 is assembled by first securing the members 54 and 56 within the through openings 72, 74, which may be accomplished by adhesively securing the outer walls 92, 94 of the bodies 88, 90 to the opposed long stretches of the sidewalls 68 and 70, or by any other convenient means. Thereupon, the upper frame part 60 is positioned so that the sidewalls 68, 70 extend through the openings 50, 52, followed by installation of the lower frame part 62 with the sidewalls 80, 82 thereof placed in surrounding relationship to the sidewalls 68, 70. As such, the upper and lower frame parts 60, 62 effectively sandwich the bill 44 with the resilient members 54, 56 situated within the bill through openings 50, 52. The frame parts 60, 62 may be adhesively interconnected at the junctures between the sidewalls 68, 70 and 80, 82.

It will be observed that in the embodiment of FIGS. 6-11, the frame parts 60, 62 are curved in a manner to accommodate the curved bill 44. However, some hat wearers prefer a flat bill cap 102 such as that illustrated in FIG. 12, having a projecting flat bill 104. In this case, the retainer structure 46*a* is identical with structure 46 described above, except that the frame parts thereof are flat to properly fit to the bill 104.

While the presently preferred retainer structures 46 and 46*a* have rows of opposed, substantially rectilinear, resilient fingers 96, 98, the invention is not so limited. For example, inwardly extending projections of different configurations may be employed, such as cylindrical fingers, rounded nibs, or frustoconical elements. Further, it is not essential that a plurality of rows of projections be used, and indeed a single row of projections may be employed. Generally speaking, it is only necessary that the projections resiliently engage and frictionally hold eyeglasses in place within the retainer structures 46 and 46*a*.

In especially preferred embodiments, the resilient projections should be formed of a synthetic rubber or rubber-like material having durometer value of from about Shore 00/60 through about Shore D/80. Further, the innermost ends of these projections may be in point contact or spaced apart a distance of from essentially 0 to about ⅛ inch, to thereby define the passageway 100.

It will be appreciated that the invention does not unduly detract from the appearance of ball caps. That is to say, there are no prominent upstanding structures on the bill which can block viewing of a logo or the like on the cap and otherwise create an unnatural wearing experience for the user, i.e., the upper surface of the bill is substantially identical with a conventional bill, and has no significant upstanding eyeglass-retainer structure mounted thereon. Indeed, the cap does not present any alterations which would change the visual impression thereof, as compared with a conventional cap.

We claim:

1. Headwear comprising:

a head-receiving section; and a bill protruding from said section in a forward direction, said bill having eyeglass-retainer structure including at least one elongated eyeglass-retaining slot formed therein and positioned forwardly of said section, said slot extending through a thickness of said bill and operable to receive and hold the lower margin of a pair of eyeglasses, said slot sized and configured to prevent any substantial passage of the eyeglass lenses through the slot, and to allow manual removal of the eyeglasses from the slot, said slot being elongate with a length greater than the width thereof and presenting a longitudinal axis, and elongated, opposed, front and rear margins, said slot longitudinal axis being transverse to said forward direction, and said front and rear margins both spaced forwardly of said head-receiving section.

2. The headwear of claim 1, said at least one slot comprising a pair of substantially aligned slots formed in said bill and each extending through a thickness of said bill, each of said slots of said pair thereof sized and configured to receive the lower margin of one of the lenses of said eyeglasses, each of said slots of said pair thereof being elongate with a length greater than the width thereof and presenting a longitudinal axis and elongated, opposed, front and rear margins, each of said slot longitudinal axes being transverse to said forward direction and both of said front and rear margins of said pair of slots spaced forwardly from said head-receiving section.

3. The headwear of claim 1, including a cloth lining along the surfaces of said at least one slot.

4. The headwear of claim 1, said at least one slot extending completely through the thickness of said bill.

5. The headwear of claim 1, said at least one slot being a recess extending through the top surface of the bill, but not completely through the bill.

6. The headwear of claim 1, said at least one slot having a plurality of inwardly extending resilient projections operable to engage said lower margin of said eyeglasses.

7. The headwear of claim 6, said projections comprising generally opposed resilient fingers.

8. The headwear of claim 7, said fingers arranged in vertical rows.

9. The headwear of claim 1, said bill being curved.

10. The headwear of claim 1, said bill being substantially flat.

11. The headwear of claim 1, said head-receiving section including a dome.

12. The headwear of claim 1, said slot being generally quadrate in shape.

13. The headwear of claim 1, said lower margin of said eyeglasses comprising an eyeglass frame.

* * * * *